US006170715B1

(12) United States Patent
Evans

(10) Patent No.: US 6,170,715 B1
(45) Date of Patent: Jan. 9, 2001

(54) BEVERAGE DISPENSER

(75) Inventor: Timothy F. Evans, Victoria (AU)

(73) Assignee: Versa Pak Pty. Ltd., Victoria (AU)

( * ) Notice: Under 35 U.S.C. 154(b), the term of this patent shall be extended for 0 days.

(21) Appl. No.: 09/202,111

(22) PCT Filed: Jun. 20, 1997

(86) PCT No.: PCT/AU97/00392

§ 371 Date: Mar. 4, 1999

§ 102(e) Date: Mar. 4, 1999

(87) PCT Pub. No.: WO97/48623

PCT Pub. Date: Dec. 24, 1997

(30) Foreign Application Priority Data

Jun. 20, 1996 (AU) ..... PO 0566
Dec. 3, 1996 (AU) ..... PO 3992

(51) Int. Cl.[7] ..... B65D 35/30
(52) U.S. Cl. ..... 222/340; 222/386.5
(58) Field of Search ..... 222/340, 387, 222/386, 386.5, 95, 105

(56) References Cited

U.S. PATENT DOCUMENTS

| | | | | |
|---|---|---|---|---|
| 3,421,664 | * | 1/1969 | Sokol | 222/340 |
| 3,565,292 | | 2/1971 | Jinotti . | |
| 3,938,706 | | 2/1976 | Cohen . | |
| 4,157,771 | | 6/1979 | Smith . | |
| 4,160,513 | * | 7/1979 | Cockerman | 222/340 |
| 4,264,109 | | 4/1981 | Knox et al. . | |
| 4,752,018 | | 6/1988 | Rudick et al. . | |
| 4,756,450 | * | 7/1988 | Negaty-Hindi et al. | 222/340 |
| 4,771,918 | | 9/1988 | Haggart . | |
| 4,854,483 | | 8/1989 | Haggart . | |
| 4,907,724 | | 3/1990 | Wing, Jr. et al. . | |
| 5,139,169 | | 8/1992 | Boyer . | |

FOREIGN PATENT DOCUMENTS

| | | |
|---|---|---|
| B-55398/80 | 10/1980 | (AU) . |
| 28687/84 | 4/1984 | (AU) . |
| 12370/83 | 9/1984 | (AU) . |
| B-32502/84 | 7/1985 | (AU) . |
| 48697/90 | 8/1990 | (AU) . |
| 14513/92 | 3/1992 | (AU) . |
| B-53935/96 | 11/1996 | (AU) . |
| 0250640 | 1/1988 | (EP) . |

* cited by examiner

*Primary Examiner*—Philippe Derakshani
(74) *Attorney, Agent, or Firm*—Sheridan Ross P.C.

(57) ABSTRACT

A dispenser (10) includes a housing (11, 13, 14), a bladder (18) for containing a beverage, the bladder (18) receivable in the housing (11, 13, 14), a bearing plate (15), braking means (35, 36) for the bearing plate (15), and urging means (17) for urging the bearing plate (15) towards the bladder (18) whereby to facilitate dispensing of the beverage from the bladder (18).

25 Claims, 6 Drawing Sheets

BEVERAGE DISPENSER

The present invention is directed to improvements in or relating to dispensers, and more particularly but not exclusively to improvements to beverage dispensers for dispensing carbonated beverages.

BACKGROUND OF THE INVENTION

In a social environment, or at a social gathering such as a party, it is generally desirable to have beverages, particularly alcoholic beverages, readily available. In the case of alcoholic beverages such as beer, the beer is usually provided in glass bottles or in aluminium cans, which are stored in a refrigerator, or in a sink, bathtub or other container filled with ice to keep the beer cold, to which guests have access during the party. In some cases, depending on the numbers attending, a keg may be ordered. To some beer connoisseurs a keg is preferable to bottled or canned beer, as some consider that keg beer has a better flavour and head when the beer is drawn into a glass, and is able to retain head longer (ie. it does not tend to de-gasify or go flat), than bottled or canned beer.

Kegs for holding beer for subsequent dispensing are produced in two main sizes, ie. 9-gallon and 18-gallon kegs, and in either size are large volumes and expensive to purchase. Furthermore, unless the numbers at the social gathering are large, or the attendees have an unusually large thirst, more often than not there is a not insubstantial amount of beer left over which remains in the keg and which has to be ultimately discarded.

In addition, the keg is effectively temporarily leased from the establishment from where the beer is purchased, requiring the keg to be returned following use.

Wine casks are also known for the dispensing of beverages such as wine, fruit juices and water. These arrangements have been found to be acceptable for the dispensing of the aforementioned beverages, which are generally non-carbonated.

However, wine casks have to date been found to be unsuitable for the dispensing of carbonated beverages such as beer or soft drinks, as the carbonated beverage has been observed to display a tendency to de-gasify if placed in a wine cask for a period and subsequently dispensed.

SUMMARY OF INVENTION

The present invention accordingly provides in one embodiment a dispenser unit for dispensing a beverage, the dispenser unit including a housing for receiving a bladder containing a beverage, a bearing plate, and urging means to facilitate dispensing of the beverage from the bladder.

The present invention provides in another embodiment a dispenser for dispensing a beverage, the dispenser including a housing, a bladder for containing a beverage, the bladder being receivable in the housing, a bearing plate, and urging means for urging the bearing plate towards the bladder whereby to facilitate dispensing of the beverage from the bladder.

The present invention provides in another embodiment a dispenser unit for dispensing a beverage, the dispenser unit including a housing for receiving a bladder containing a beverage, a bearing plate, braking means for the bearing plate, and urging means to facilitate dispensing of the beverage from the bladder.

The present invention provides in another embodiment a dispenser for dispensing a beverage, the dispenser including a housing, a bladder for containing a beverage, the bladder receivable in the housing, a bearing plate, braking means for the bearing plate, and urging means for urging the bearing plate towards the bladder whereby to facilitate dispensing of the beverage from the bladder.

A housing according to the invention may take any suitable form. The shape of the housing may to an extent be dictated by the shape of a bladder to be received in the housing. The housing preferably forms a receptacle for a bladder according to the invention receivable therein. The housing may enclose the bladder. The housing may be in the form of a container whereby the bladder is received in the container. In one embodiment the housing fully encloses the bladder whereby to form a closed container for the bladder. The housing may form a sealed container whereby to enclose a bladder according to the invention in a sealed manner.

The housing may be elongated whereby the length dimension of the housing is greater than the width dimension of the housing, or vice versa. In one embodiment, the housing comprises a tube. The tube may be elongated. In another embodiment the housing comprises a box. The box may be elongated. The box may have an open top. The box may be square. It may be circular. It may be rectangular. The box may enclose the bladder.

In another embodiment the housing may be in the shape of a keg if the contents to be dispensed from the bladder is beer. In another embodiment the housing may be in the shape of soft drink bottle if the contents to be dispensed from the bladder is a soft drink.

Other housing shapes, constructions and arrangements are envisaged within the scope of the present invention.

The housing may be formed from any suitable material. The material may be selected to facilitate ease of assembly of the housing. Suitable materials include cardboard, such as a waxed cardboard, and plastics materials such as PET. Other materials for forming the housing are envisaged within the scope of the invention.

A housing according to the invention may be formed in one piece. In one embodiment, the housing may be formed from a unitary blank. The blank may be constructed and arranged to define when assembled a container for enclosing a bladder according to the invention, whereby the blank is assembled by folding the blank into the desired shape for enclosing the bladder.

The housing may be formed from a plurality of assemblable components. The components may be integral with one another as in the case of a unitary blank. The arrangement is preferably such that the components are capable of interengaging or interlocking with one another whereby to form a housing when assembled. An assemblable component according to the invention may carry a tab capable of interengaging with a corresponding recess carried by an adjacent component for assembly. In another embodiment, the assemblable component may carry an upstanding member formable into or formed as a hook, tongue, ridge, projection, lug or similar configuration capable of interengaging, interlocking with or being received in a corresponding recess carried by an adjacent component whereby to form an assemblable housing. Other interengaging or interlocking arrangements are envisaged within the scope of the present invention.

In one particularly preferred embodiment, the housing comprises an elongated tube having a continuous outer wall and end members, distal and proximal edges of the outer wall being arranged to foldably interengage over and/or with corresponding upstanding edges of the end members whereby to form a sealed container housing a bladder according to the invention.

A dispenser according to the invention may include outlet means for the bladder. The outlet means may be capable of facilitating the removal of contents of the bladder for dispensing. The outlet means may be in the form of a valve mounted on the bladder. Where the contents of the bladder is a carbonated beverage, the valve is preferably arranged to resist ingress of air into the bladder through the valve on opening the valve. The valve may accordingly be a one-way valve.

In an alternative embodiment according to the invention, outlet means for the bladder may be mounted on the housing whereby the bladder includes an outlet member engageable with the outlet means to facilitate dispensing of the contents of the bladder through the outlet means. In this embodiment, the bladder may include an outlet member engageable with the outlet means by a snap-fit arrangement whereby to form a valve capable of resisting ingress of air into the bladder through the valve on opening the valve.

The mounting of outlet means according to the invention on or to the housing and its positioning relative to the housing may be by any suitable form.

The outlet means may be located on the dispenser in a position whereby to facilitate dispensing of beverage from the bladder. The outlet means may be located at or near the base of the dispenser whereby gravity feed assists in dispensing of beverage from the bladder. In one embodiment, the outlet means is adapted to pass through an aperture in a side wall of the housing. In another embodiment, the outlet means is adapted to pass through an aperture in an end wall of the housing.

The outlet means may be secured to the housing. The outlet means may be releasably secured to the housing. In one embodiment the outlet means is mounted on the housing by means of a valve support. The valve support may be recessed. The valve support may be apertured to receive outlet means passed therethrough. In one embodiment part of the housing is apertured to receive outlet means according to the invention passed therethrough whereby egress of the contents of the bladder from the bladder may be facilitated through the outlet means. In a particularly preferred embodiment, the housing comprises a recessed end member, the recess apertured to receive a valve for the bladder passed therethrough.

Outlet means according to the invention may include foam reduction means for bladder contents dispensed through the outlet means. The arrangement may be such that the beverage is held for a sufficient time by the foam reduction means whereby to facilitate a reduction of foam in the dispensed beverage. The foam reduction means may be located at a downstream end of outlet means according to the invention.

Foam reduction means according to the invention may take any suitable form. In one embodiment, the foam reduction means is in the form of a tube generating a tortuous path for the beverage whereby the length of the tortuous path is predetermined to provide sufficient residence time in the tube for the beverage whereby carbonating gas is dissipated from the dispensed beverage into the atmosphere. In another embodiment, the foam reduction means takes the form of a holding chamber. In another embodiment, the foam reduction means may take the form of braking means for the bearing plate.

A bladder according to the invention is preferably collapsible. The arrangement is preferably such that the wall(s) of the bladder is/are collapsible in response to a pressure transmitted to the bladder and/or in response to egress of contents of the bladder from the bladder.

A bladder according to the invention may be in the form of a bag in which a beverage is receivable. The bag is preferably sealable to prevent contents of the bag from escaping when placed in the bag. The bag may be in the style of a liner for a wine cask modified according to the invention for the type of beverage to be dispensed. This arrangement has been found to be particularly suitable for use in the practice of the present invention.

The bladder is preferably formed from a material suitable for hygienic contact with fluids for human consumption. As an example of one material suitable for use as a bladder according to the invention, a liner for a wine cask would be suitable if the beverage to be dispensed is wine. Similar metallised, laminate or multi-layer films could be used to form a bladder for other beverages.

The bladder should be of sufficient strength to withstand internal pressures generated by the contents of the bladder. The bladder should be of sufficient strength to withstand external pressure applied or transmitted to an outer wall of the bladder by the bearing plate.

For dispensing applications where the beverage to be dispensed is carbonated, the bladder is preferably substantially impermeable whereby to prevent permeation of the carbonating gas through the walls of the bladder to any significant extent and to maintain the beverage carbonated.

Typical bladder volumes for dispensers according to the invention include 4, 6 and 10 liters. These volumes have been found to be particularly advantageous for the dispensing of beverage to small to medium-sized gatherings. Other bladder volumes are envisaged within the scope of the present invention.

A bearing plate according to the invention is preferably capable of transmitting pressure to the bladder whereby to facilitate the egress of contents of the bladder from the bladder when the outlet means for the bladder is opened. The pressure transmitted to the bladder by the bearing plate is preferably a compressive force.

The bearing plate may bear directly on the bladder, whereby pressure is applied by the bearing plate to an outer wall of the bladder.

In one embodiment, the bearing plate transmits a constant pressure to the bladder. The arrangement is preferably such that the pressure transmitted to the bladder by the bearing plate is substantially evenly distributed to the bladder. In an embodiment where the bearing plate is in direct contact with the bladder, pressure applied to the bladder is preferably substantially evenly distributed to an outer wall of the bladder at points of contact of the bearing plate with the bladder walls.

In an embodiment where the bearing plate bears directly on the bladder, the bearing plate may include a contact face for contacting the bladder, whereby a contact face of the bearing plate bears directly on an outer wall of the bladder. The arrangement is preferably such that the contact face does not puncture or otherwise interrupt the integrity of the bladder wall(s) with which it comes into contact.

A contact face of a bearing plate according to the invention may take any suitable form. The contact face may be substantially flat. It may be sloping. A plurality of contact faces may be provided. The contact faces may be joined by a bridge. The bridge may be symmetrically disposed about an axis of the dispenser.

A bridge for a bearing plate according to the invention may take any suitable form. In one embodiment, the bridge comprises an inverted substantially U-shaped member.

In one embodiment, the bearing plate includes a pair of upwardly sloping, outwardly extending arms, the leading faces of the arms forming contact faces for the bladder, and adapted to bear on an outer wall of the bladder in a region of the bladder opposite its dispensing end.

In a particularly preferred embodiment, a bearing plate according to the invention includes a bridge comprising a substantially inverted U-shaped member having an arm extending outwardly of each upstanding arm of the inverted U, the arms sloping in an upward direction.

The bearing plate may include a guide. The guide may assist in maintaining the orientation of the bearing plate relative to the bladder and/or the dispenser housing whereby pressure transmitted to the bladder by the bearing plate is maintained substantially evenly distributed across the bladder. The arrangement is preferably such that the bearing plate is maintained substantially level by the guide.

The guide may be capable of engaging a wall of the housing. The guide may frictionally engage a wall of the housing. A guide according to the invention may extend from the bearing plate. In one embodiment the guide extends at least partly around the perimeter of the bearing plate whereby to frictionally engage a wall or walls of the housing. A guide according to the invention may be carried by a bearing plate arm. The guide may be arranged so that a leading edge thereof extends in the direction of travel of the bearing plate relative to the housing. The guide may comprise a fin, ridge, wing or lug. Other bearing plate guide arrangements are envisaged within the scope of the present invention.

It will be appreciated that foaming can be a particular problem in the dispensing of carbonated beverages from containers, including dispensers constructed and arranged in accordance with the present invention. In the case of the present invention, foaming of the dispensed beverage may result from pressure applied or transmitted to the bladder, and hence the contents of the bladder, by or through the bearing plate. I have also found that the volume of available head space in the bladder ie. the volume of air above the liquid, has a bearing on the degree to which carbonating gas such as carbon dioxide can expand into the head space and hence leave the beverage solution. If this volume is controlled I have observed that a limitation in de-gasification of the beverage inside the bladder can be achieved.

In cases where foaming may be a particular problem, such as in the case of highly carbonated beverages such as soda water, I provide an alternative form of foam reduction means in the form of braking means for the bearing plate. The arrangement is preferably such that the pressure applied to the bladder by or through the bearing plate is limited by the action of the braking means retarding the movement of the bearing plate in response to urging means provided in accordance with the invention. The arrangement is also preferably such that the available head space within the bladder, ie. the volume available for expansion of gaseous contents of the bladder, is limited by the action of the braking means.

Braking means according to the invention may take any suitable form. The arrangement is preferably such that the braking means frictionally engages with a wall of the housing. The braking means may extend from the bearing plate. In one embodiment the braking means extends at least partly around the perimeter of the bearing plate whereby to frictionally engage a wall or walls of the housing. A bearing plate arm may carry braking means according to the invention.

The arrangement is preferably such that the braking means is capable of being activated, ie. to perform a braking function, or deactivated, ie. to be released from a braking function, as the case may be in response to pressure changes within the bladder or in response to the closing and opening of valve means associated with the bladder. The braking means is preferably cooperable with the inner wall of the housing whereby to limit movement of the bearing plate in a longitudinal direction relative to the housing.

In one particularly preferred embodiment the braking means is capable of engaging or disengaging with a wall of the housing in response to the closing and opening of the tap or valve means. The braking means may frictionally engage an inner wall of the housing.

In one embodiment the braking means extends at least partly around the perimeter of the bearing plate whereby to frictionally engage an inner wall of the housing. A bearing plate arm may carry braking means according to the present invention.

The braking means may be in the form of a braking member. The arrangement is preferably such that the braking member is capable of engaging or disengaging an inner wall of the housing.

The braking member may comprise a skirt. The skirt may be operatively capable of contacting an inner wall of the housing whereby to hold the bearing plate relative to the wall of the housing and hence to limit or prevent movement of the bearing plate. The arrangement is preferably such that the skirt is capable of flexing inwardly or outwardly whereby to disengage or engage with an inner wall of the housing in response to pressure changes within the bladder whereby to control movement of the bearing plate in the longitudinal direction of the housing.

The skirt may depend from the bearing plate. The skirt may depend at least partly around the perimeter of the bearing plate. The skirt may flex inwardly or outwardly relative to the axis of the bearing plate. The skirt may be connected to the bearing plate by means of a hinge. The hinge is preferably disposed in a transition region between the main body of the bearing plate and the skirt. In one embodiment the skirt is hinged to the bearing plate by means of a live hinge also known as a living hinge. In this way the skirt is capable of pivoting relative to the bearing plate in response to forces applied to the bearing plate. The skirt is preferably arranged relative to the bearing plate whereby it trails the intended direction of movement of the main body of the bearing plate. The skirt may be arranged in segments around the perimeter of the bearing plate.

The arrangement is preferably such that the skirt moves inwardly away from the wall of the housing by pivotal movement of the hinge in response to pressure equalisation within the housing or pressure reduction within the bladder such as by the opening of the valve whereby permitting engagement means for the braking means to come out of engagement whereby the bearing plate is able to advance to facilitate egress of contents of the bladder from the bladder. When the pressure within the bladder is greater than the countervailing pressure of the bearing plate and urging means the skirt moves outwardly towards the wall of the housing and engages with the housing thereby halting movement of the bearing plate.

The braking member may comprise at least one leg. A braking member leg according to the invention is preferably capable of operatively contacting an inner wall of the housing whereby to hold the bearing plate relative to the wall of the housing and hence to limit or prevent movement of the bearing plate. The leg may extend from the bearing plate. The leg may extend from an arm carried by the bearing plate. The leg may flex inwardly or outwardly relative to the axis of the bearing plate whereby to disengage or engage an inner wall of the housing in response to pressure changes within the bladder whereby to control movement of the bearing plate.

The braking means may be in the form of a braking member having a leg for contacting a wall of the housing. The leg may extend from the bearing plate arm. The leg may flex outwardly whereby to engage a wall of the housing in response to movement of the bearing plate. The braking means may comprise a pair of legs. The legs may be angled towards a wall of the housing in a direction away from the direction of travel of the bearing plate. The braking means may comprise a fork.

In a particularly preferred embodiment, the braking means comprises a braking member carried by a bearing plate arm and extending substantially around the perimeter of the bearing plate, the braking member having a pair of legs adapted to frictionally engage a wall or walls of the housing.

The leg may depend from the bearing plate. The leg may depend from the bearing plate at least partly around the perimeter of the bearing plate. The leg may flex inwardly or outwardly relative to the axis of the bearing plate. The leg may be connected to the bearing plate by means of a hinge. The hinge is preferably disposed in a transition region between the main body of the bearing plate and the leg. In one embodiment the leg is hinged to the bearing plate by means of a live hinge also known as a living hinge. In this way the leg is capable of pivoting relative to the bearing plate in response to forces applied to the bearing plate. The leg is preferably arranged relative to the bearing plate whereby it trails the intended direction of movement of the main body of the bearing plate. The leg may be arranged in segments around the perimeter of the bearing plate.

Similarly, the arrangement is preferably such that the leg moves inwardly away from the wall of the housing by pivotal movement of the hinge in response to pressure equalisation within the housing such as by the opening of the valve whereby permitting the engagement means to come out of engagement whereby the bearing plate is able to advance to facilitate egress of contents of the bladder from the bladder. When the pressure within the bladder is greater than the countervailing pressure of the bearing plate and urging means the leg moves outwardly towards the wall of the housing and engages with the housing thereby halting movement of the bearing plate.

Control of the movement of the bearing plate may include permitting the bearing plate to advance, or stopping the motion of the bearing plate. Other forms of control of the movement of the bearing plate are envisaged within the scope of the invention.

Braking means according to the invention may include engagement means whereby to facilitate control of movement of the bearing plate in response to changes in internal pressure within the bladder.

Engagement means according to the invention may be in the form of a two-component means. The components may be complementary. The arrangement is preferably such that the components of the two-component engagement means are releasably interengageable.

One component of a two-component engagement means according to the invention may be associated with the bearing plate. In one embodiment one component of the engagement means is carried by the bearing plate.

The second component of a two-component engagement means according to the invention may be associated with a wall of the housing. In one embodiment the second component is carried by an inner wall of the housing. The second component may be integrally formed with an inner wall of the housing.

One component of the two-component engagement means may comprise a recess. The second component of the two-component may comprise a projection receivable in the recess.

A projection according to the invention may be in the form of a tooth. The tooth preferably extends outwardly that is to say in the direction of the inner wall of the housing. In one preferred embodiment one component of the two-component engagement means comprises a plurality of outwardly projecting teeth capable of engaging with complementary teeth arranged proximate the inner wall of the housing.

A recess according to the invention may be arranged on an inner wall of the housing. The recess may be in the form of a rack comprising a plurality of recesses. A rack according to the invention may comprise a plurality of teeth. The teeth may be capable of interengaging in complementary fashion with teeth of the first component of the two-component engagement means whereby to form when engaged braking means capable of holding the bearing plate.

In one particularly preferred embodiment a first component of the two-component engagement means comprises a plurality of teeth carried by the bearing plate and the second component comprises a rack extending along part of the inner wall of the housing, the teeth and the rack being releasably interengageable.

Other engagement means are envisaged within the scope of the present invention.

In another embodiment a skirt as described depending from the bearing plate may carry one component of the two-component engagement means. The skirt may be connected to the bearing plate by means of a hinge as described. In similar manner the skirt may be move as described in response to the opening and closing of the valve.

The bearing plate may be located substantially within the housing. In a particularly preferred embodiment the bearing plate is located within the housing and is movable in an axial direction of the housing. The bearing plate may be constructed and arranged to be symmetrically disposed about a longitudinal axis of the housing.

The shape of the bearing plate is dictated to a large extent by the shape of the housing into which it is received. Preferably the shape of the bearing plate is complementary to the shape of the inner wall of the housing. In the case of a cylindrical housing the bearing plate may be substantially circular. In the case of a square or rectangular housing, the bearing plate may be substantially square or rectangular.

The bearing plate may be in the form of a disk adapted to bear on a bladder located within the dispenser housing. One or more radial members may extend from the disk. The radial members preferably extend to or near to the wall of the housing. A leading edge of a radial member may be shaped to substantially conform with the shape of the wall of the housing. Where the bearing plate includes a plurality of radial members, the members are preferably opposed members. A radial member according to the invention may carry engagement means as described. A radial member may be a skirt, leg or arm as described.

Urging means according to the invention is preferably arranged to urge the bearing plate to bear on the bladder whereby to facilitate egress of a quantity of the contents of the bladder from the bladder. Movement of the bearing plate may accordingly be effected by pressure transmitted to the bearing plate by the urging means. In a particularly preferred embodiment, urging means according to the invention bear on the bearing plate to urge the bearing plate in an axial direction of the housing whereby to transmit a compressive force to a bladder located within the housing. The force transmitted to the bearing plate by the urging means is dependent on the pressure under which the beverage is stored in the bladder.

In one embodiment the urging means comprises a spring or other biasing member to urge the bearing plate to bear on the bladder. The spring or other biasing means is preferably extendable in the direction of the bearing plate. In another embodiment, the urging means comprises a plunger. In a further embodiment, urging means according to the invention comprises in combination a spring or other biasing means and a plunger.

The urging means is preferably mountable on the housing. The urging means may be mountable within the housing. In one embodiment the urging means is mounted in a recess in an end wall of the housing.

In a preferred embodiment, the urging means comprises a large diameter spring having an external diameter slightly less than an internal width dimension of the housing whereby the spring is adapted to urge on the bearing plate over a large contact area of the spring with the bearing plate.

The strength of the urging means is preferably such that the volume of the bladder is reduced when a quantity of beverage is expelled from the bladder.

A dispenser according to the invention may include locating means for the urging means. The arrangement may be such that the locating means is adapted to resist lateral movement of the urging means relative to the bearing plate.

The locating means may engage the urging means. A bearing plate according to the invention may carry locating means for the urging means. In an embodiment where the bearing plate comprises a bridge, the bridge may carry the locating means on a face thereof.

Locating means according to the invention may take any suitable form. In one embodiment where the urging means comprises a spring or other biasing means, the locating means may comprises a projection mounted on the bearing plate and receivable in an end of the spring whereby to locate the spring relative to the bearing plate. In this embodiment the locating means retards any change in the spring centre relative to the bearing plate.

A housing according to the invention may provide a support for the urging means. The housing may be recessed to receive the urging means. The housing may be apertured to receive the urging means. In an embodiment where the urging means comprises a spring or other biasing member the housing may be recessed whereby the spring nests in the recess. In an embodiment where the urging means comprises a plunger, the housing may be apertured to receive a plunger passed therethrough.

A dispenser according to the invention may be operable in a vertical or horizontal orientation.

Elements of a dispenser according to the invention may be disposable or recyclable. The arrangement may be such that the dispenser housing is formed from an inexpensive material which can be easily discarded, or if preferred recycled, following use. Where the housing is formed from a cardboard box, the box may be flattened and made available for recycling. Similarly, where the housing is formed from a plastics material, such as a PET, the plastics material may be made available for recycling.

The bladder may be disposable or recyclable. Where the bladder is in the form of a laminated or multi-layer plastics material the bladder may be made available for recycling or easily discarded in a waste bin.

A dispenser constructed in accordance with the invention has been found to be particularly adapted to the dispensing of carbonated beverages such as beer and soft drinks.

It will be appreciated that a dispenser according to the present invention may be capable of dispensing flowable fluids other than beverages, including foodstuffs such as mayonnaise and sauces. Other flowable fluids for dispensing are envisaged within the scope of the invention.

The arrangement of the braking means is preferably such that pressure applied to the bladder by or through the bearing plate is limited by the action of the braking means retarding movement of the bearing plate in response to urging means provided in accordance with the invention.

The present invention is thought to limit the extent to which the bladder can expand longitudinally inside the bladder housing. Internal pressures in the bladder can increase when the bladder is shaken or is exposed to temperature rises. When the pressure in the bladder exceeds the countervailing pressure of the bearing plate and urging means, the braking means is thought to act to prevent the bladder from expanding longitudinally to any significant extent as a consequence of increased internal pressure within the bladder. When the opposing pressures generated by the internal bladder contents on the one hand and the bearing plate and urging means on the other equalise, or when the pressure in the bladder is less than the pressure of the bearing plate and urging means, the braking means is thought to act to permit the bearing plate to advance and facilitate egress of the contents of the bladder in response to opening of the tap or valve means associated with the bladder.

When the tap or valve means is opened the contents will flow out of the bladder under substantially constant pressure limiting or substantially preventing the formation of a head space within the bladder.

Whilst not wishing to be bound by any particular theory, it is thought that the volume of available head space in the bladder, ie. the volume of gas, such as carbonating gas, above the fluid held in the bladder, has a bearing on the degree to which carbonating gas such as carbon dioxide in solution in the fluid can expand into the head space and hence leave the beverage solution. Transfer of the carbonating gas from solution into the available head space is also thought to contribute to increased internal pressures within the bladder.

If that volume is controlled we have observed that a limitation in de-gasification of the beverage inside the bladder can be achieved. In addition, it is thought that as a consequence, a build-up in internal pressures within the bladder is less likely to occur.

A housing, bearing plate, urging means and valve means according to the present invention may be substantially as described. Other constructions and arrangements are also envisaged within the scope of the present invention. For example, components may according to the invention be constructed at least partly from mouldable plastics materials.

It has been observed that if dispensers made in accordance with the present invention are knocked or shaken the internal pressure of the bladder contents is likely to overcome the force of the urging means giving the bladder the opportunity to expand and create a head space within the bladder above the bladder contents. If that occurs, the braking means will activate and prevent the bladder from expanding. When the bladder contents has settled the braking means will deactivate and the urging means will take over, and normal flow will occur.

It has also been observed that if the valve is opened while the braking means is activated a higher than normal flow of bladder contents from the bladder can be expected, until the pressure is reduced sufficiently for the braking means to deactivate and for the urging means to take over and for normal flow to resume.

DESCRIPTION OF PREFERRED EMBODIMENT

The present invention will now be described with reference to particularly preferred embodiments in which.

For convenience, in the drawings like integers have generally been accorded like reference numerals.

Figure 1:
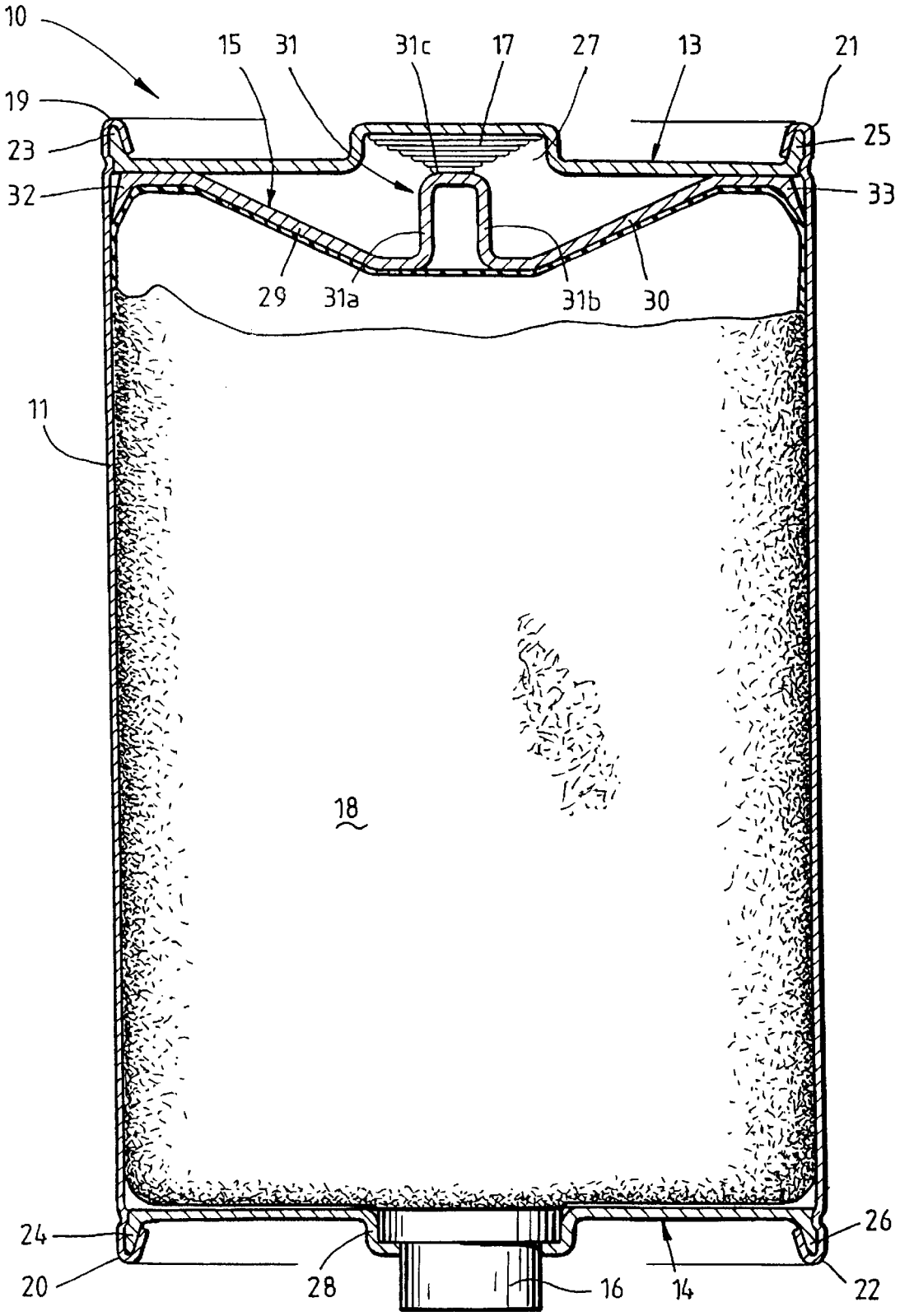
FIG. 1 is a cross-sectional elevation of a dispenser according to one embodiment of the present invention with the bladder in inflated condition.

Turning to the drawings, FIG. 1 shows generally a dispenser 10 for dispensing beverages. Dispenser 10 is particularly suitable for the dispensing of carbonated beverages.

Dispenser 10 is in the embodiment shown in the form of an elongated tube of waxed cardboard having a continuous wall 11. Wall 11 together with end members 13, 14 defines a housing for receiving a bladder 18 for containing a beverage. It will be appreciated that other dispenser housing arrangements are envisaged within the scope of the present invention.

Dispenser 10 includes a bearing plate 15, and urging means in the form of a spring 17 to facilitate dispensing of beverage from bladder 18.

Outlet means are provided in the form of a valve 16 seated in a recess 28 of end member 14 of dispenser 10.

In the embodiment shown, wall 11 of dispenser 10 includes edge members 19, 20, 21, 22 foldable inwardly over outwardly extending edges 23, 25 and 24, 26 of end members 13, 14 respectively to provide an interlocking arrangement whereby the housing thus formed provides a sealed container housing bladder 18 according to the invention.

It will be appreciated that other container sealing arrangements are envisaged within the scope of the present invention.

Bearing plate 15 includes a substantially inverted U-shaped bridge member 31 having legs 31*a*, 31*b*, from which extend outwardly and upwardly bearing plate arm members 29, 30 respectively. Arm members 29, 30 terminate in guides 32, 33 adapted to frictionally engage, wall 11 of dispenser 10. This arrangement has been found to facilitate stabilisation of the bearing plate 15 relative to an outer wall of bladder 18 whereby a substantially evenly distributed constant pressure can be transmitted to the bladder wall.

Urging means in the form of spring 17 are provided to bear on surface 31*c* of bearing plate 15 whereby to transmit pressure to bearing plate 15.

Face 31*c* of bearing plate bridge member 31 includes locating means for the spring in the form of an upstanding projection 34 adapted to resist lateral movement of the spring relative to bearing plate 15.

Figure 2:
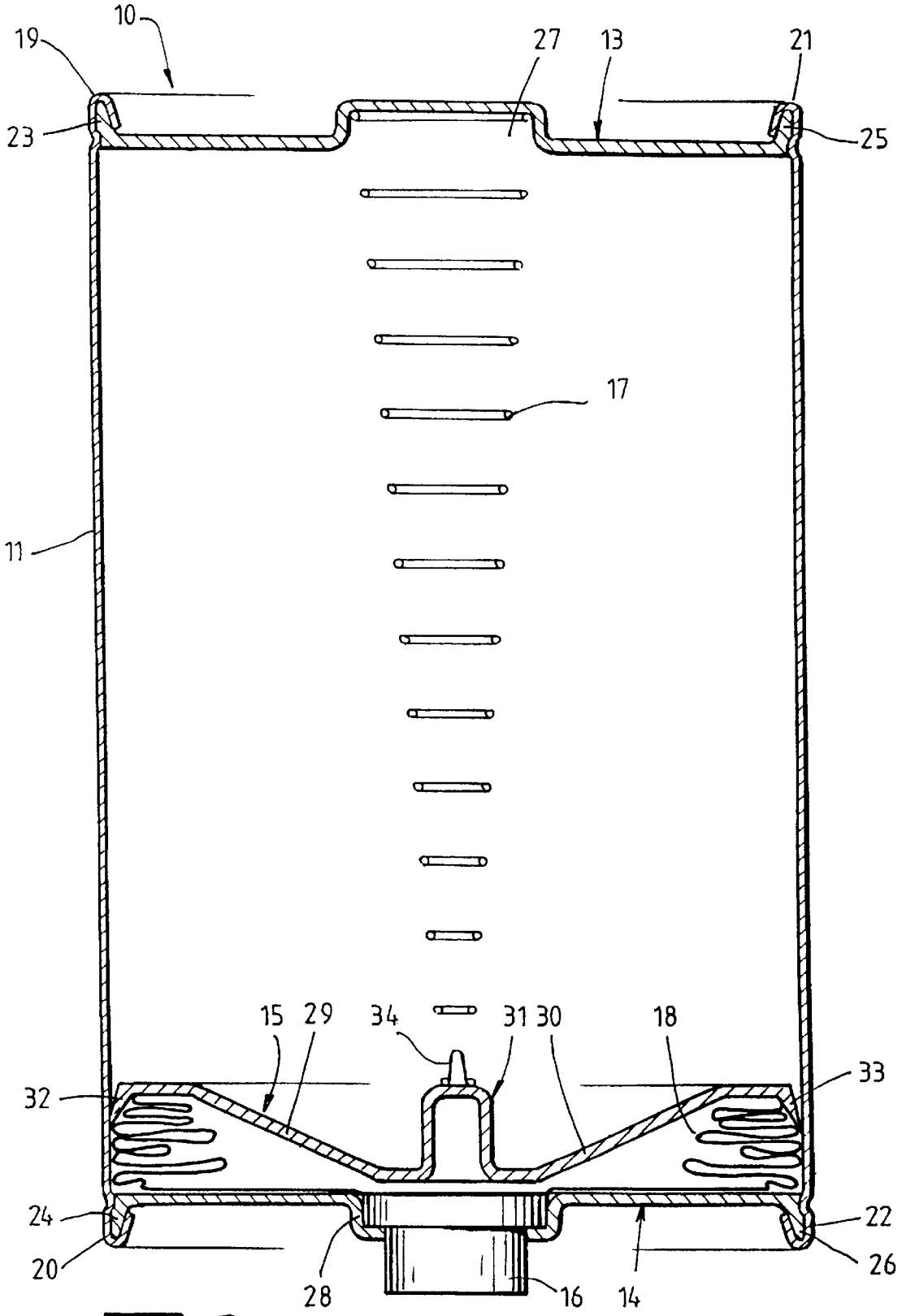
FIG. 2 is a cross-sectional elevation of a dispenser according to the embodiment of FIG. 1 with the bladder in collapsed condition.

It can be seen from FIG. 2 that with the spring 17 in extended condition the bearing plate 15 bears on bladder 18 whereby to collapse the bladder 18 to the condition as shown in FIG. 2 whereby the contents of the bladder have been substantially expelled through outlet means 16.

Figure 3:
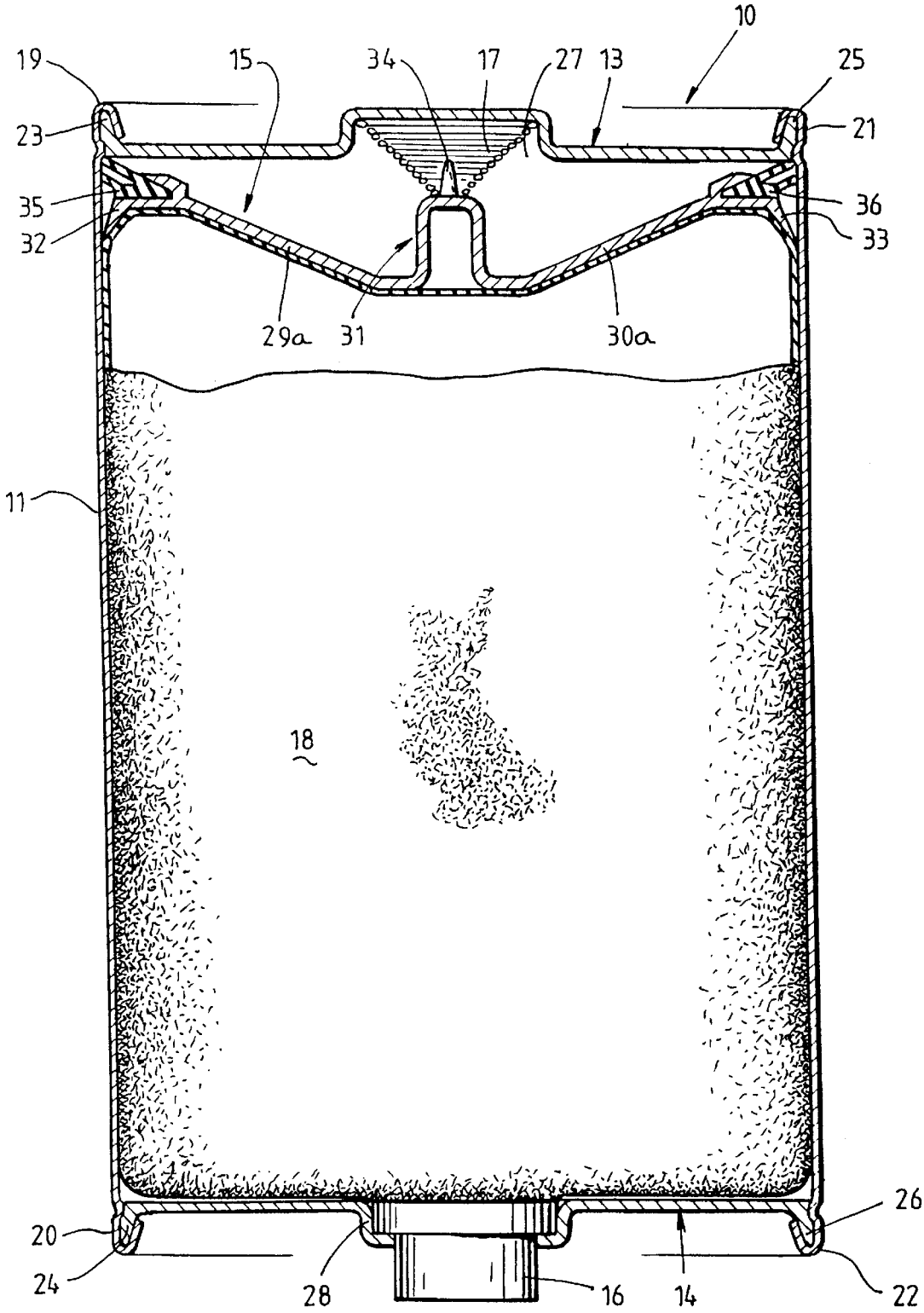
FIG. 3 is a cross-sectional elevation of a dispenser according to another embodiment of the present invention with the bladder in inflated condition.
Figure 4:
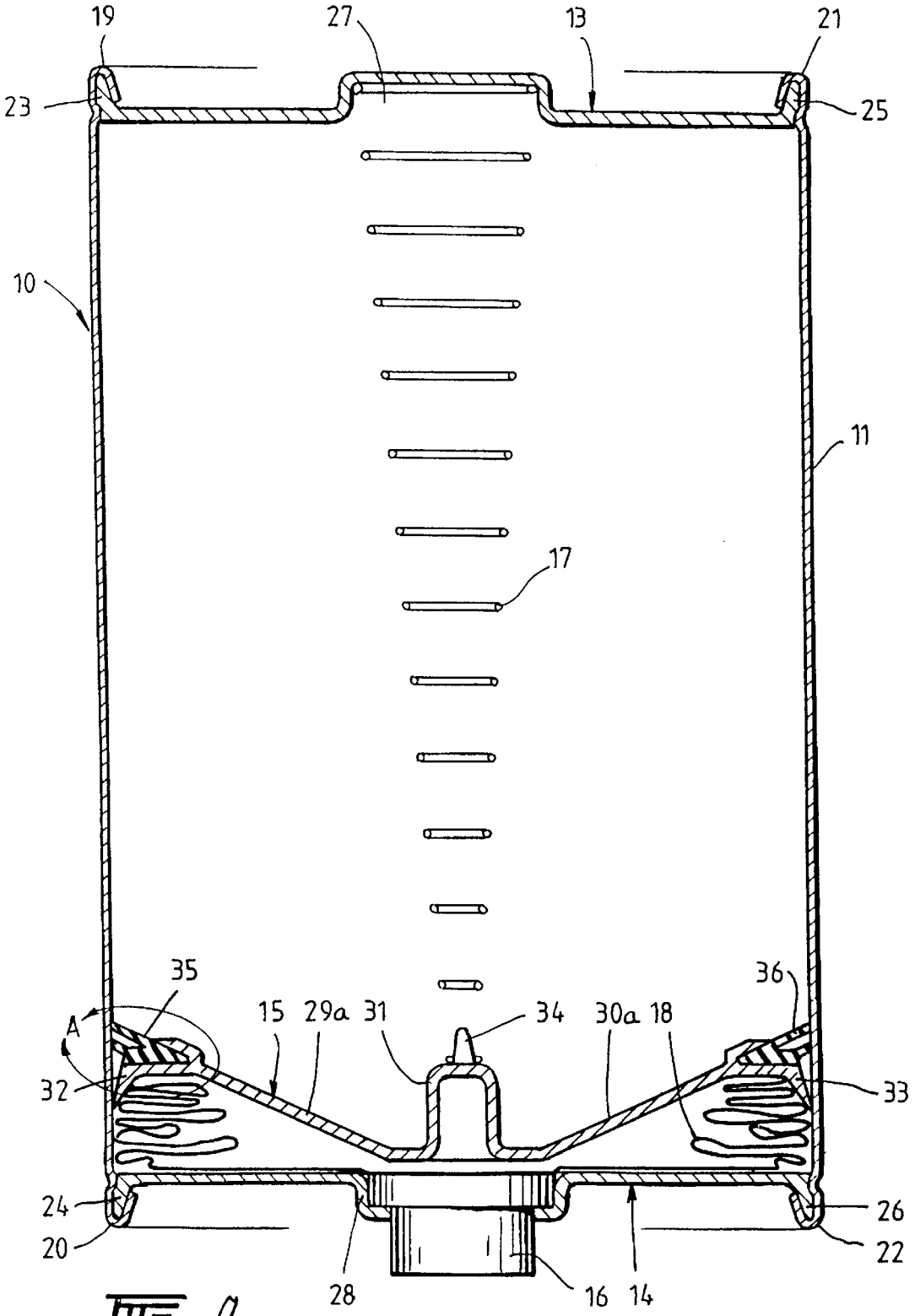
FIG. 4 is a cross-sectional elevation of a dispenser according to the embodiment of FIG. 3 with the bladder in collapsed condition.

The embodiment of FIGS. 3 and 4 is substantially the same as that of FIGS. 1 and 2 except for the provision of braking means in the form of braking members, 35, 36, which in the embodiment shown are carried by modified arms 29*a*, 30*a* of bearing plate 15. Braking members 35, 36 have been found to be particularly adapted for use in instances where highly carbonated beverages having a tendency to foam are to be dispensed from dispenser 10.

Braking members 35, 36 are adapted to frictionally engage the inner surface of wall 11 of dispenser 10 whereby to retard movement of bearing plate 15 in the direction of bladder 18 in response to an urging force applied to bearing plate 15 by spring 17.

Figure 5:
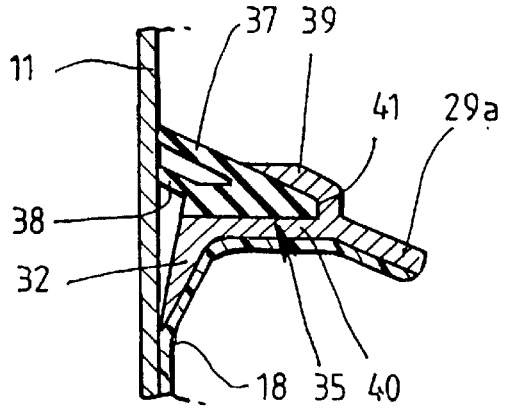
FIG. 5 is a detailed cross-sectional view of the portion of FIG. 4 marked with an A.

FIG. 5 shows braking member 35 having a body portion and a pair of trailing legs 37, 38 engaging wall 11. Braking member 35 is adapted to be inserted into cradle 41 defined by arms 39, 40 of arm member 29*a* of bearing plate 15. It will be appreciated that braking members 35, 36 can in alternative embodiment be integral with arm members 29*a*, 30*a* of bearing plate 15.

Figure 8:
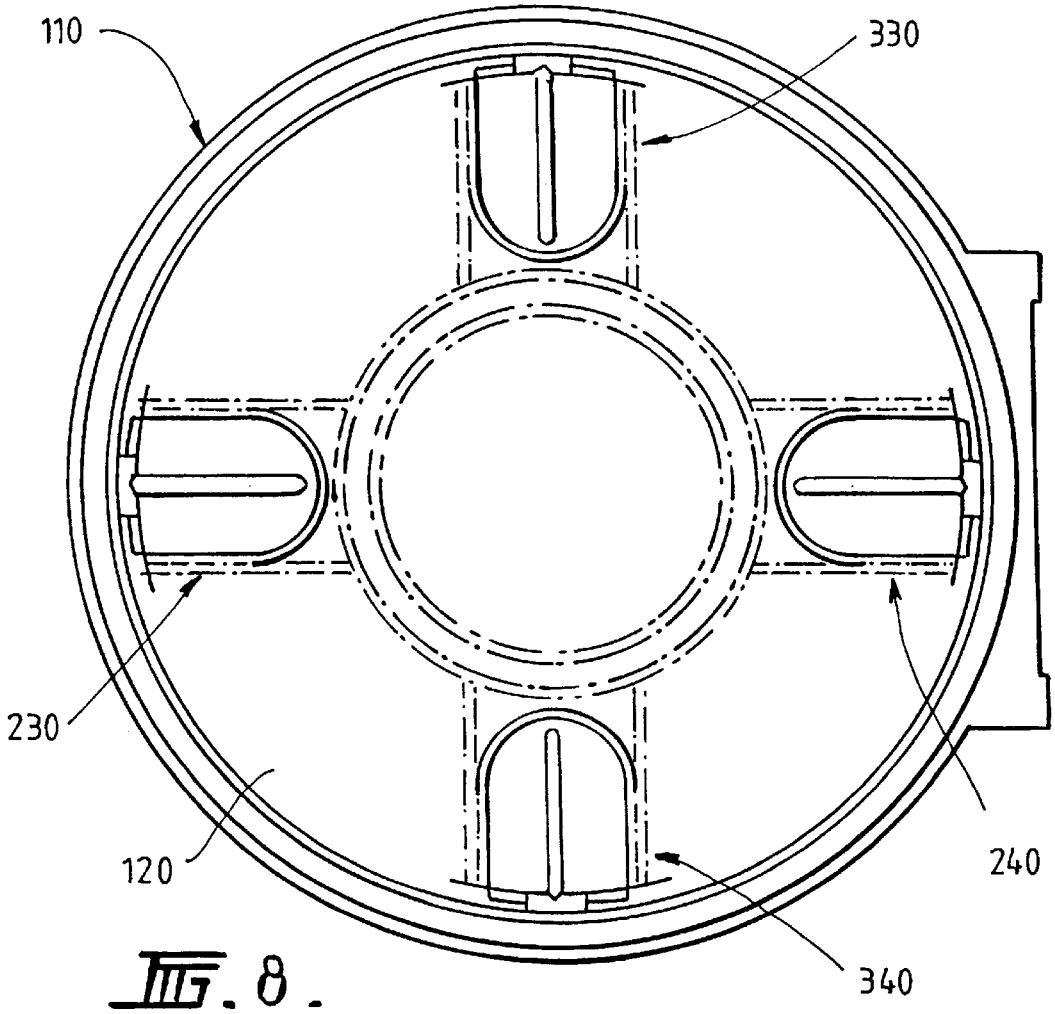
FIG. 8 is an end view with end cap removed of a dispenser according to one embodiment of the present invention having a bearing plate position therein.
Figure 6:
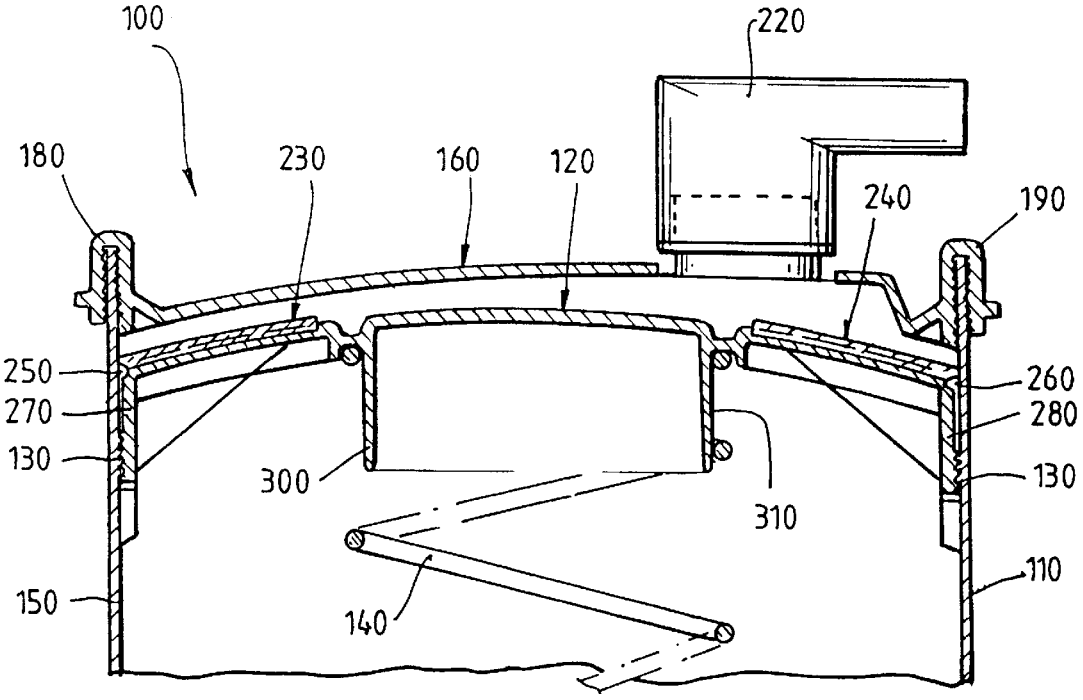
FIG. 6 is a cross-sectional side elevation of the dispensing end of a dispenser according to one embodiment of the invention with the urging means in extended condition.
Figure 7:
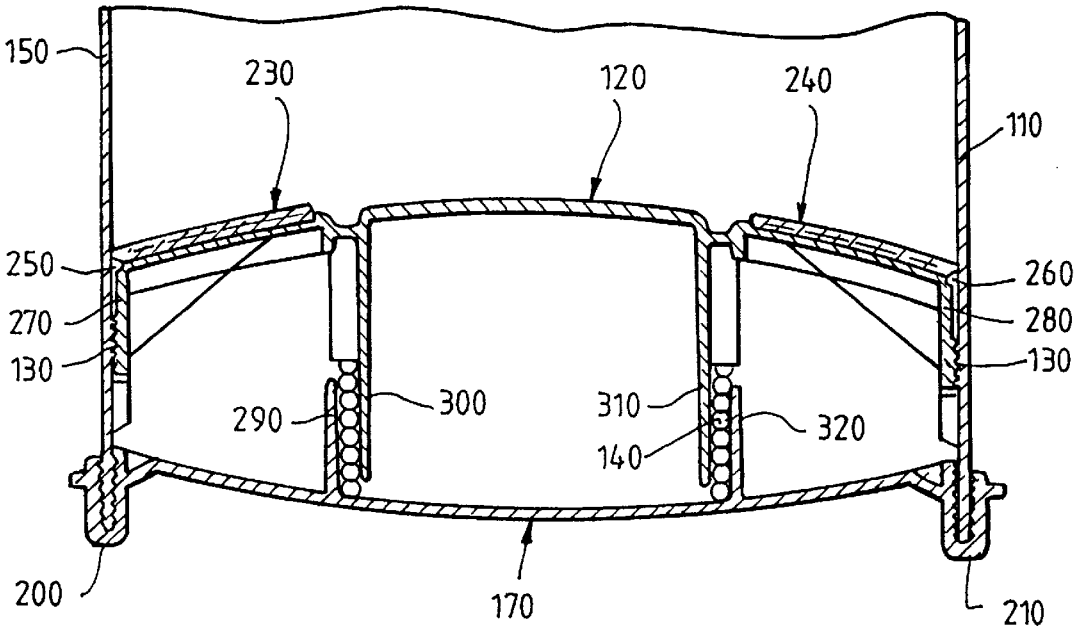
FIG. 7 is a cross-sectional side elevation of the non-dispensing end of a dispenser according to one embodiment of the invention with the urging means in contracted condition.

FIGS. 6 to 8 show generally a dispenser 100 for dispensing beverages. Dispenser 10 includes a housing 110 for receiving a bladder (not shown) containing a beverage, a bearing plate 120, braking means 130 for the bearing plate, and urging means 140 to facilitate dispensing of the beverage from the bladder. A valve 220 is provided in an end cap 160 to facilitate dispensing of beverage or other fluid from the bladder.

Housing 110 in the embodiment shown comprises a continuous outer wall 150 and end caps 160, 170 (see for example FIG. 7) whereby to enclose the bladder. End caps 160, 170 in the embodiment shown are attached to respective end portions of wall 150 such as by screwing, clamping, crimping or via rolled seams at points 180, 190, 200 and 210 as shown. Other forms of attachment are envisaged within the scope of the present invention.

Dispenser 100 includes urging means in the form of a spring 140 to urge against bearing plate 120. Bearing plate 120 and end cap 170 carry complementary guides 290, 300, 310 and 320 to assist in maintaining the form of the spring and in guiding the spring to operate in the longitudinal direction of housing 110.

Bearing plate 120 in the embodiment shown in FIGS. 6 to 8 is in the form of a disk adapted to bear against the bladder and includes arms 230, 240, 330 and 340, from which legs 270, 280 (only two shown) depend. Legs 270, 280 are connected to the bearing plate 120 via live hinges 250, 260 permitting the legs to pivot relative to the bearing plate 120.

Legs 270, 280 include braking means for the bearing plate 120. In the embodiment shown the braking means 130 comprises a two-component engagement means in the form of complementary interengaging teeth.

It can be seen from FIGS. 6 and 7 that legs 270, 280 carry one component of the two-component braking means in the form of teeth shown as 130 extending in an outward direction towards the inner wall of the housing 110. Teeth 130 engage with complementary teeth in the form of a rack (not fully shown) arranged on an inner wall of the housing 110. The rack extends at least partly along the inner wall of the housing 110.

In use, a housing in the form of a closed container is provided in which a bladder containing a beverage is placed. A bearing plate carrying braking means is located in the housing and urging means in the form of a spring positioned relative to the housing to urge the bearing plate towards the bladder. The outlet means for the bladder in the form of a one-way valve is secured to the housing, and the dispenser is placed on a counter or table ready for dispensing. Opening of the valve to dispense a quantity of beverage results in the bearing plate being urged to bear on the bladder whereby to facilitate egress of contents from the bladder. This sequence may be repeated as desired. The braking means is capable of being activated or deactivated in response to pressure changes within the bladder or in response to the opening and closing of the valve. The braking means is particularly adapted to engage or disengage with a wall of the housing in response to the closing and opening of the valve.

In relation to the embodiment of FIGS. 6 to 8, when the contents of the bladder expands, such as in consequence of temperature or pressure increases, the bladder expands longitudinally within the bladder housing and bears against the against the bearing plate. When that occurs, the braking means pivots outwardly towards the inner wall of the housing and one component of the two-component engagement means of the braking means in the form of teeth carried by a leg of the bearing plate interengage with the second component of the two-component engagement means in the form of complementary teeth carried by a rack located on the inner wall of the housing. Interengagement of the teeth effectively prevents or limits to any appreciable extent movement of the bearing plate relative to the housing. The stronger the force applied to the bearing plate by the expansion of the bladder the more securely the teeth will interengage. As the pressure on the bearing plate eases the legs pivot inwardly relative to the inner wall allowing the teeth to come out of engagement, thereby releasing the bearing plate and permitting it to advance whereby to facilitate egress of contents of the bladder from the bladder in response to the opening of the valve.

The present invention has the particular advantage that carbonated beverages are capable of being dispensed without significant loss of carbonation resulting from the contents of the bladder left for a period of time. In addition, the invention provides an inexpensive, disposable device as an attractive alternative to conventional containers for carbonated beverages.

Whilst it has been convenient to describe the invention herein in relation to particularly preferred embodiments, it is to be appreciated that other constructions and arrangements are considered as falling within the scope of the invention. Various modifications, alterations, variations and/or additions to the constructions and arrangements described herein are also considered as falling within the scope and ambit of the present invention.

What is claimed is:

1. A dispenser unit for dispensing a beverage, the dispenser unit including a housing for receiving a bladder containing a beverage, a bearing plate for applying a compressive force to a bladder when received in the housing, braking means for the bearing plane, and urging means adapted to urge the bearing plate to bear on the bladder to facilitate dispensing of the beverage from the bladder, wherein said braking means is releasably engageable with a wall of said housing such that it is capable of being activated or deactivated in response to pressure changes within the bladder whereby to limit expansion of said bladder.

2. A dispenser unit according to claim 1, wherein said bearing plate bears directly on said bladder whereby to apply a compressive force to said bladder.

3. A dispenser unit according to claim 1, wherein said urging means comprises a spring mountable within said housing for urging said bearing plate to bear on said bladder.

4. A dispenser according to claim 1, wherein said bladder is collapsible at least one of (a) in response to a pressure transmitted to a wall of the bladder and (b) in response to egress of contents of the bladder from the bladder.

5. A dispenser unit according to claim 1, wherein said braking means comprises a braking member frictionally engageable with a wall of said housing and releasable in response to a pressure change within said bladder.

6. A dispenser unit according to claim 2, wherein said braking member comprises a flexible member capable of flexing inwardly or outwardly relative to an inner wall of said housing whereby to disengage or engage with said inner wall in response to pressure changes within said bladder whereby to limit expansion of said bladder and to control movement of said bearing plate in the longitudinal direction of said housing.

7. A dispenser unit according to claim 6, wherein said braking member depends from said bearing plate.

8. A dispenser unit according to claim 7, wherein said braking member comprises at least one leg or a skirt.

9. A dispenser unit according to claim 1 and further including outlet means for the bladder.

10. A dispenser unit according to claim 9, wherein said outlet means comprises a valve arranged to resist ingress of air into the bladder on opening the valve.

11. A dispenser according to claim 1, wherein said bladder is in the form of a liner bag.

12. A dispenser according to claim 11, wherein said bag is substantially impermeably whereby to prevent permeation of gas in solution in the beverage through the walls of the bladder to any significant extent.

13. A dispenser for dispensing a beverage and including a dispenser unit according to claim 1 and a bladder in the form of a liner bag receivable in said housing.

14. A dispenser unit according to claim 1, wherein said bearing plate is movable in an axial direction along a longitudinal axis of the housing.

15. A dispenser unit for dispensing a carbonated beverage, said dispenser unit including a housing for receiving a substantially impermeable bladder containing a carbonated beverage, outlet means for said bladder comprising a valve arranged to resist ingress of air into said bladder through said valve on opening said valve, a bearing plate located within the housing arranged to transmit a compressive force to said bladder whereby to prevent formation of a head space within said bladder, a spring mountable within said housing and adapted to urge the bearing plate to bear on said bladder, braking means adapted to releasably engage with a wall of said housing whereby to prevent expansion of said bladder in response to pressure changes within said bladder, the arrangement being such as to facilitate dispensing of said beverage from said bladder.

16. A method for dispensing a beverage, comprising:

providing a dispenser unit including a housing for receiving a bladder containing a beverage, a bearing plate, and a brake engaging the bearing plate, applying a compressive force to the bladder using the bearing plate to pressurize the beverage;

activating the brake when the pressure in the bladder exceeds a pressure level; and deactivating the brake when the pressure in the bladder is no more than the pressure level.

17. The method of claim 16, wherein the pressure level is related to a force exerted by a spring against the bearing plate.

18. The method of claim 16, wherein the activating step includes:

pivoting a leg of the bearing plate outwardly towards an inner wall of the housing and engaging teeth attached to the leg with complementary teeth attached to the inner wall.

19. The method of claim 16, wherein the deactivating step includes:

pivoting a leg of the bearing plate inwardly towards an inner wall of the housing and disengaging teeth attached to the leg from complementary teeth attached to the inner wall.

20. A dispenser unit according to claim 16, wherein said bladder is collapsible at least one of (a) in response to a pressure transmitted to a wall of the bladder and (b) in response to egress of contents of the bladder from the bladder.

21. A dispenser unit according to claim 16, wherein said brake is releasably engageable with a wall of the housing.

22. A dispenser unit according to claim 16, wherein the housing includes an outlet for dispensing the beverage and wherein said outlet comprises a valve arranged to resist ingress of air into the bladder on opening the valve.

23. The method of claim 16, wherein said brake comprises a flexible member capable of flexing inwardly or outwardly relative to an inner wall of said housing whereby to disengage or engage with said inner wall in response to pressure changes within said bladder whereby to limit expansion of said bladder and to control movement of said bearing plate in the longitudinal direction of said housing.

24. The method of claim 16, wherein said brake depends from said bearing plate.

25. The method of claim 16, wherein said brake comprises at least one leg or a skirt.

* * * * *